United States Patent [19]

Harmsen et al.

[11] 3,932,936

[45] Jan. 20, 1976

[54] METHOD OF MANUFACTURING A DUCTILE SILVER METALLIC OXIDE SEMI-FINISHED PRODUCT CONTACTS

[75] Inventors: Ulf O. Harmsen, Pforzheim; Wolfgang Pöttken, Keltern; Egon Oertel, Pforzheim, all of Germany

[73] Assignee: Dr. Eugene Durrwachter DODUCO, Pforzheim, Germany

[22] Filed: July 12, 1974

[21] Appl. No.: 487,870

Related U.S. Application Data

[63] Continuation-in-part of Ser. No. 442,683, Feb. 14, 1974.

[30] Foreign Application Priority Data

July 21, 1973 Germany ..... 2337197

[52] U.S. Cl. ..... 29/630 C; 29/497.5; 72/258; 72/363

[51] Int. Cl.[2] ..... H01R 9/00

[58] Field of Search ..... 72/258, 362, 363; 29/420.5, 472.3, 497.5, 498, 630 C, 504; 200/262, 265, 266

[56] References Cited

UNITED STATES PATENTS

| | | | |
|---|---|---|---|
| 3,114,631 | 12/1963 | Sistare et al. | 29/630 C |
| 3,144,576 | 8/1964 | Hagmaier et al. | 72/258 |
| 3,258,829 | 7/1966 | Gwyn | 200/266 |
| 3,510,935 | 5/1970 | Durrwachter et al. | 29/420.5 |
| 3,545,067 | 12/1970 | Haarbye et al. | 29/630 C |
| 3,673,667 | 7/1972 | Loewenstein et al. | 29/420.5 |
| 3,802,062 | 4/1974 | Harmsen et al. | 29/630 C |
| 3,814,640 | 6/1974 | Shibata | 29/630 C |
| 3,821,841 | 7/1974 | Goodwin | 29/420.5 |
| 3,821,848 | 7/1974 | Backstrom | 29/630 C |
| R27,075 | 2/1971 | Murphy et al. | 29/420.5 |

*Primary Examiner*—C. W. Lanham
*Assistant Examiner*—James R. Duzan

[57] ABSTRACT

There is produced a ductile silver-metallic oxide semi-finished product, for example a silver cadmium oxide wire, or a sheet or square rod having silver-metallic oxide, silver-metallic, and silver metalloid compounds. There are assembled in sandwich fashion several plates of internally oxidized silver-metallic oxide and of powder metallurgically produced silver-metallic oxide. The sandwich is then extrusion pressed.

7 Claims, 2 Drawing Figures

Figure 1:
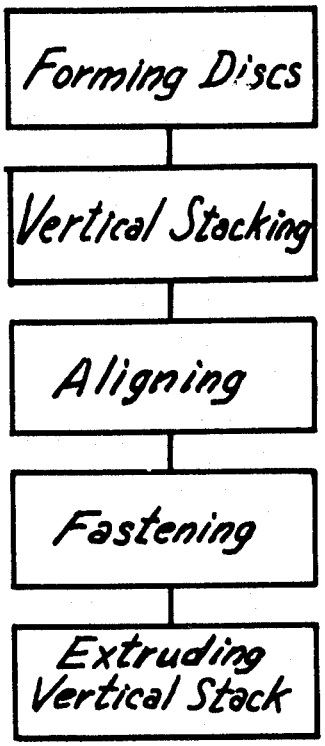

METHOD OF MANUFACTURING A DUCTILE SILVER METALLIC OXIDE SEMI-FINISHED PRODUCT CONTACTS

THE INVENTION

This invention is a continuation-in-part of applicants' earlier filed co-pending application U.S. Ser. No. 442,683 filed Feb. 14, 1974 entitled "Method for Manufacturing a Ductile Silver Metallic Oxide Semi-Finished Product."

The present invention relates to a method of manufacturing a ductile silver metallic oxide semifinished product for producing contacts.

Silver metallic oxide materials with oxide contents of 2 to 20% by weight, in particular silver cadmium oxide, silver tin oxide and silver zinc oxide are known to have a very low tendency to fuse and are used to a large extent as electrical contacts for switching mechanisms with high switching rates at low or medium loads (H. Schreiner, Pulvermetallurgie elektrischer Kontakte, Springer-Verlag, Berlin, Gottingen, Heidelberg, 1964, p. 163 ff.).

It is generally recognized that the best known contact material of the silver metallic oxide group is silver cadmium oxide. Since silver cadmium oxide is a relatively brittle substance, to facilitate the additional treatment of existing material as silver cadmium oxide to make electrical contacts, the ductility of the material is important (*A. Keil, Zeitschrift fur Metallkunde* 57 (1966) issue No. 2, pp. 151–155).

Silver metallic oxide substances can be produced according to the process of internal oxidation — if the oxides do not produce surface layers — and in accordance with the powder metallurgical process (H. Schreiner, Pulvermetallurgie electrischer Kontakte, Springer-Verlag, Berlin, Gottingen, Heidelberg, 1964, pp. 164–185).

Upon the internal oxidation of wire or bar material, fissures and hollows arise in the peripheral zone crystal boundary. These fissures and hollows are caused by internal stresses which arise from the increase in volume during oxidation (A. Keil, lecture "Bemerkungen zur inneren Oxidation von Silber-Cadmium-Legierungen" Kontakttagung Orono, Proceed III Intern.Res.-Symp. on Electrical Contact Phenomena, June, 1966). In spite of the use of additions to refine the crystal structure so as to increase the ductility e.g. with silver cadmium materials (German Pat. No. 1,153,178), it has been frequently observed that material pre-oxidized in wire form becomes unusable during deformation to make the contact assembly using a rivet (or pin) because of fissures at the head of the rivet. Wire with high oxide contents of, say, 15% by weight cadmium oxide and copper oxide cannot be produced free of fissures by using the internal oxidation method since wide cracks arise in the wire due to the change in volume during the oxidation process.

Silver tin oxide and silver zinc oxide materials with oxide contents from 5% by weight upwards cannot be produced by internal oxidation since surface layers interfer with the oxidation mechanism and a uniform oxidation front cannot be achieved. These materials can be produced only by using powder metallurgy. Powder metallurgical manufacture of wire of bar material lessens fissure formation through change in volume, but even such a powder metallurgical material having a high oxide content of about 15% by weight is brittle and not easily deformable.

It is an object of the present invention to produce a wire or bar made from silver metallic oxide with high oxide contents of 5 to 20% by weight which is ductile, has no fissures in the material and is suitable for rivet hammering.

According to the present invention a method of producing a ductile silver metallic oxide semifinished product, especially for the preparation of electrical contacts, comprises the steps of assembling several of any internally oxidized silver-metallic oxide plates, silver metalloids and powder metallurgically produced silver-metallic oxide plates to form a bar, and pressing the bar. It has been found that a wood-like fibrous structure of the metallic oxide stratum has a favourable effect on subsequent handling of the semifinished product to form a rivet and the connection between the individual sheets is perfect. In this way, for example, silver cadmium oxide wires, sheets and rods with silver-metallic, silver-metallic oxide and silver-metalloid ingredients can be produced.

EXAMPLE 1

20 plates of AgCd, having dimensions of 4 × 80 350 mm and having a nickel additive of about 0.2% by weight to refine the crystals, were internally oxidized for 2 days at 820°C at an oxygen pressure of 3 atm., then alid one on top of the other to oorm a package measuring 80 × 80 × 350mm that was flattened under a press. At the corners the plates were secured by riveting or welding to maintain the package. This square bar was pressed at 500°C in a 500 ton extrusion press to form a wire of 7mm diameter. The wire, by repeated intermediate annealing, was perfectly drawn to 2.85mm diameter and hammered into rivets measuring 7mm head diameter, 1.5mm head height, 3mm tail length and 3mm tail diameter.

EXAMPLE 2

80 plates of AgCd measuring 1 × 80 × 250mm were oxidized at 820°C at an oxygen pressure of 3 atmospheres for 14 hours and subsequently processed as described in Example 1.

EXAMPLE 3

40 plates of AgCd measuring 1 × 80 × 350mm were internally oxidized for 14 hours in air at 820°C and alternately laid one on top of the other with plates of Ag/graphite 99/1 or Agni 90/10 or AgCuO 8 to form a package 80 × 80 ×350mm, and then processed as in Example 1.

EXAMPLE 4

20 plates, measuring 4 × 80 × 350mm, of powder metallurgically produced AgCdO 10 were laid one on top of the other to form a package 80 × 80 × 350mm and extrusion pressed to form a wire 7mm diameter and then processed as in Example 1 to make rivets.

EXAMPLE 5

40 plates, measuring 2 × 80 × 350mm, of powder metallurgically produced AgZnO 10, or $AgZnO_2$ 10, or $AgFe_2O_3$ 10, or $AgIn_2O_3$, or AgCuO 10, $AgMoO_3$ 5 were laid one on top of the other to form a package measuring 80 × 80 × 350mm and extrusion pressed to form a wire of 7mm diameter and processed as in Example 1 to form rivets.

EXAMPLE 6

40 powder metallurgically produced plates, including AgCdO 15, or AgZnO 15, or $AgSnO_2$ 10, or $AgFe_2$ 10, were applied one on top of the other altenately with plates of Ag/graphite 99/1, or AgNi 10, or AgCuO 8, all measuring 1 × 80 × 350mm to form a square pressed bar 80 × 80 8 350mm and then processed as in Example 1.

In the above examples the bar was extruded as a rectangular section bar. In this case the extruded bar had a packing density of almost 100%. Processing of these bars requires the extrusion press to have rectangular receiving members which are difficult to manufacture, and are therefore very expensive.

Further, the possible combinations of materials in a rectangular-section bar are less than in a loosely-bundled cylindrical pressed bar since the cylindrical bar has a greater surface area. Examples 7–13 relate to particularly preferred embodiments of the present invention wherein the pressing bar consists of one of a vertical arrangement of discs and a loose bundle or axially arranged parallel rods.

Figure 2:
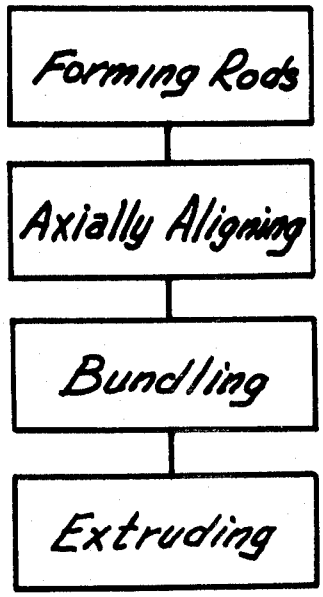

FIGS. 1 and 2 illustrate the alternative methods of the subject invention. The FIGS. are flow charts which illustrate the process steps involved.

FIG. 1 illustrates the process whereby the discs are used to produce the ductile silver metallic oxide semi-finished product. As illustrated in this figure, the discs of silver metallic oxide, and/or silver metal, and/or silver metalloid are formed and then vertically stacked. After stacking, the discs are aligned for fastening which may be done e.g. by welding the edges and then the fastened, aligned stack is then extruded.

In the other alternative embodiment of this invention, rods may be used as illustrated in FIG. 2. The rods after forming are axially aligned and then loosely bundled for subsequent extrusion.

Both of these processes produce the substantial benefits described throughout this specification.

Surprisingly, it has been found that, despite the loose bundling of the rods and the consequent relatively low packing density, the compressed bar can be perfectly extruded into a wire with circular or angular cross-section, and said wire is sufficiently ductile to enable rivets to be hammered therefrom without the occurrence of cracks.

EXAMPLE 7

A plurality of discs of 80mm diameter and a sheet thickness of 1 to 2 mm, are made up into a round block 350 mm long, held together at the edges by welding. This round block is extruded at 500°C in a 500 *t* extrusion press, to produce a wire with a diameter of 7 mm. After intermediate annealing, the wire can be perfectly drawn to a diameter of 2.85 mm, and hammered into rivets with the following dimensions: head diameter 7 mm, head height 1.5 mm, shaft length 3 mm, and shaft diameter 3 mm.

EXAMPLE 8

AgCdO-15 wires which are oxidised throughout, or wires manufactured by a powder metallurgical process, consisting of AgCdO15, AgZnO10, $AgZnO_25$, AgCuO10 and others, with diameter of 1 to 5 mm, are bundled, singly or mixed, to form a block with diameter 80 mm and length 350 mm, heated to extrusion temperature in a retort furnace, and pressed into a wire of 7 mm diameter. The wire is further process according to the details in Example 7.

EXAMPLE 9

A pressing bar comprises a bundle with a mixture sequence of 50% powder-metallurgically produced AgCdO10 rods of diameter 2 mm and length 350 mm, and 50% powdermetallurgically produced AgNi10 rods of 1 mm diameter and 350 mm length. The bar is extruded to a wire of 7 mm diameter, and further process according to Example 7.

EXAMPLE 10

A pressing bar comprises a bundle mixture sequence of 50% powder-metallurgically produced AgCuO10 rods of 1.5mm diameter, 25% powder-metallurgically produced Ag-graphite 99/1 rods of 2 mm diameter, and 25% powder-metallurgically produced AgNi10 rods of 1 mm diameter. The bar is extruded to a wire of diameter 7 mm.

EXAMPLE 11

Bimetallic coated wires of 3 mm diameter made of AgCdolo with an AgNi10 coating of 0.5 mm thick, are bundled into a pressing bar, and extruded to a wire 7 mm in diameter.

EXAMPLE 12

50% of a bundled pressing bar consists of braided AgCdO10 and AgCuO10 wires 2 mm in diameter, and 50% of twisted AgNilo rods 2 mm in diameter. The pressing bar can be extruded to 7 mm in diameter.

EXAMPLE 13

A bundled pressing bar consists of 50% of twisted round rods 1.5 mm in diameter, of AgCdO15 and AgNi10, and angular rods of AgCuO5 with a cross-section of 2 × 3 mm. The pressing bar can be extruded to a diameter of 7 mm. In each of examples 4 to 7, the extruded bar can be further treated in the manner of Example 7.

What is claimed is:

1. A method for producing a ductile silver metallic oxide semi-finished product comprising:
   a. selecting rods from at least one member of a class consisting of silver metallic oxide, silver metal and silver metalloid rods;
   b. aligning a plurality of rods in an axial mode;
   c. bundling said rods;
   d. extruding said rods under conditions of elevated temperature and pressure.

2. The method of claim 1 wherein the rods consists of a core of any of a metal, silver metallic oxide and a silvermetalloid, and an outer coating of any of a metal, silver metallic oxide, silver metalloid.

3. A method as claimed in claim 1, wherein the core consists of a mixture of any of a metal, silver metallic oxide and a silver metalloid.

4. The method of claim 1 wherein the rods are profiled.

5. A method of claim 1 wherein the pressing bar consists of a loose-bundle of rods with varying cross-sectional profiles.

6. A method of claim 1 wherein the pressing bar is a loose bundle formerd from braided and twisted rods.

7. A method for producing a ductile silver metallic oxide semi-finished product comprising:

a. selecting discs from at least one member of a class consisting of silver metallic oxide, silver metal and silver metalloid discs;

b. vertically stacking said discs to form a cylinder;

c. aligning said discs;

d. fastening said discs; and e. extruding said vertically positioned discs under conditions of elevated temperature and pressure.

* * * * *